US008399869B2

(12) United States Patent
Rosier et al.

(10) Patent No.: US 8,399,869 B2
(45) Date of Patent: Mar. 19, 2013

(54) UV LUMINAIRE HAVING A PLURALITY OF UV LAMPS, PARTICULARLY FOR TECHNICAL PRODUCT PROCESSING

(75) Inventors: Oliver Rosier, Wipperfuerth (DE); Siegmar Rudakowski, Ratingen (DE); Reinhold Wittkoetter, Wipperfuerth (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 97 days.

(21) Appl. No.: 13/133,999

(22) PCT Filed: Dec. 11, 2008

(86) PCT No.: PCT/EP2008/067317

§ 371 (c)(1),
(2), (4) Date: Jun. 10, 2011

(87) PCT Pub. No.: WO2010/066298

PCT Pub. Date: Jun. 17, 2010

(65) Prior Publication Data

US 2011/0233424 A1 Sep. 29, 2011

(51) Int. Cl.
*F26B 3/28* (2006.01)

(52) U.S. Cl. ..... 250/504 R; 313/244; 313/248; 34/275; 362/263

(58) Field of Classification Search ..... 250/504 R; 313/344, 248; 34/275; 362/263
See application file for complete search history.

(56) References Cited

U.S. PATENT DOCUMENTS

| | | | | |
|---|---|---|---|---|
| 4,218,831 | A * | 8/1980 | Harris et al. | 34/275 |
| 4,494,316 | A | 1/1985 | Stephansen et al. | |
| 4,660,297 | A * | 4/1987 | Danielson | 34/275 |
| 4,962,310 | A * | 10/1990 | Hennecke et al. | 250/494.1 |
| 5,142,795 | A * | 9/1992 | Abbott | 34/444 |
| 6,323,601 | B1 * | 11/2001 | Klein et al. | 315/248 |
| 6,686,681 | B1 * | 2/2004 | Allgeier et al. | 313/318.01 |
| 6,905,230 | B2 * | 6/2005 | Schmitkons | 362/263 |
| 6,967,341 | B2 * | 11/2005 | Neff et al. | 250/504 R |
| 7,520,602 | B2 * | 4/2009 | Codos | 347/102 |
| 7,663,121 | B2 * | 2/2010 | Nowak et al. | 250/455.11 |
| 8,137,465 | B1 * | 3/2012 | Shrinivasan et al. | 118/719 |
| 8,174,191 | B2 * | 5/2012 | Hombach et al. | 313/552 |
| 8,237,364 | B2 * | 8/2012 | Hombach et al. | 313/595 |
| 8,269,190 | B2 * | 9/2012 | Dornblaser et al. | 250/455.11 |
| 8,283,644 | B2 * | 10/2012 | Smargiassi et al. | 250/504 R |
| 2002/0163312 | A1 * | 11/2002 | Kling et al. | 315/56 |
| 2010/0109505 | A1 * | 5/2010 | Rosier et al. | 313/244 |
| 2011/0056513 | A1 * | 3/2011 | Hombach et al. | 134/1.1 |

FOREIGN PATENT DOCUMENTS

| | | | |
|---|---|---|---|
| DE | 10207541 | A1 | 9/2003 |
| DE | 10333664 | A1 | 2/2005 |
| EP | 0350560 | A | 1/1990 |
| FR | 2762666 | A1 | 10/1998 |

OTHER PUBLICATIONS

International Search Report of PCT/EP2008/067317 mailed Sep. 4, 2009.
English language abstract of DE 103 33 664 A1.
English language abstract of DE 102 07 541 A1.
English language abstract of FR 2 762 666 A1.

* cited by examiner

*Primary Examiner* — David A Vanore

(57) ABSTRACT

In various embodiments, a UV luminaire may include a housing which is designed for accommodating a plurality of UV lamps and a protective atmosphere, wherein the housing is subdivided in such a manner into chambers respectively containing some of the UV lamps and can be opened in such a manner that each of the UV lamps can be replaced with detriment to the protective atmosphere only of the respective chamber.

18 Claims, 7 Drawing Sheets

UV LUMINAIRE HAVING A PLURALITY OF UV LAMPS, PARTICULARLY FOR TECHNICAL PRODUCT PROCESSING

RELATED APPLICATIONS

The present application is a national stage entry according to 35 U.S.C. §371 of PCT application No. PCT/EP2008/067317 filed on Dec. 11, 2008.

TECHNICAL FIELD

Various embodiments relate to a UV luminaire having a plurality of UV lamps in a housing which, to demarcate between the exterior and the housing interior, has, inter alia, a UV-transparent separating pane. The luminaire may e.g. be used for implementing technical processes on products, for example for surface modification in an atmosphere that is corrosive under UV irradiation.

BACKGROUND

Such UV lamps have been known for a long time and are used extensively, for example for cleaning surfaces, for supporting chemical processes, for matting lacquers or for lacquer exposure. For use in the cleaning of surfaces, for example, the UV irradiation of products under a gaseous atmosphere which is corrosive or which becomes corrosive due to the UV irradiation, can be considered. This relates in particular to VUV irradiation under an oxygen atmosphere, in which ozone is formed and contaminants on the product surface are oxidized and thereby converted into gaseous substances. This applies in particular to substrates for the manufacture of TFT displays.

In printing, on the other hand, an inert gas rather than oxygen is used, in order to reduce the absorption of the UV radiation emitted by the lamp.

In the luminaires, an inert gas is also often used in order to protect luminaire parts from corrosion and/or in order to minimize absorption.

To ensure that cleaning is as extensive as possible, to provide short process times and/or for other reasons, relatively high UV outputs are often required. Such luminaires frequently have a plurality of UV lamps in order to achieve the desired output and/or to cover the desired area.

SUMMARY

Various embodiments describe an improved luminaire for UV radiation, e.g. VUV radiation, which offers advantages in practical handling.

Various embodiments provide a UV luminaire having a housing which is designed for accommodating a plurality of UV lamps and a protective atmosphere, wherein the housing is subdivided in such a way into chambers respectively containing some of the UV lamps and can be opened in such a way that each of the UV lamps can be replaced, with detriment to the protective atmosphere only of the respective chamber.

The invention relates also to a device for implementing a handling process on products by means of such a luminaire and to the use of the luminaire for this purpose.

Preferred embodiments are indicated in the dependent claims and will be explained in greater detail hereinbelow. The features which occur may also be essential to the invention in other combinations and relate in principle to the luminaire, to the overall device and to the use, but also to a corresponding operating method or manufacturing method.

The basic idea is to be able to carry out the replacement of lamps in the luminaire that is required at regular intervals with reduced effort. In addition, the interior of the luminaire is to be affected by the replacement of a lamp only to the extent that lamps are actually replaced. The protective atmosphere that surrounds the lamps unaffected by the replacement is not to be touched. The luminaire, specifically the luminaire housing, is therefore subdivided into a plurality of chambers. Each chamber contains only some of the lamps, preferably precisely one lamp.

The protective atmosphere may be an inert-gas atmosphere, as is known in the prior art, for example including nitrogen. It may, however, also be a vacuum, for example. In each case, due to the subdivision into chambers, only the protective atmosphere in the chamber affected has to be restored, which necessitates flushing processes and/or pumping processes, in any case expenditure of time. This expenditure of time is, however, less than it would be if an entire luminaire housing interior were affected.

Furthermore, it is possible, though not imperative within the scope of the invention, for lamps accommodated in the other chamber(s) to continue to be operated. They continue to be located under a protective atmosphere, so nothing stands in the way of this.

In other respects, the risk of damage or contamination when replacing a lamp is limited to the chamber affected. So if difficulties should arise here, the luminaire as a whole including the other chambers and the lamps contained therein continues to be fit for use.

Furthermore, the luminaire according to the invention is preferably fashioned such that a UV-transparent separating pane arranged between the chamber to be opened or the entire luminaire housing interior and the irradiated area, i.e. the emission area of the luminaire housing, remains stationary and mounted in its existing position during the replacement of a lamp. The replacement of a lamp can thus be carried out without the separating pane having to be dismantled. Instead, a housing part is designed to be used for opening the housing, the separating pane remaining fixed in position relative to the rest of the luminaire.

In the case of the process device, this means that the luminaire can remain mounted on the device, the separating pane likewise remaining unchanged and the possibility thus existing of the area of the products to be treated not being touched. Contamination risks in respect of the products to be treated can thus be reduced or excluded, any seals or other structural precautions remain untouched and/or hazards to the environment caused by problematic substances, in particular corrosive gases, prevented. In the case of the aforementioned ozone cleaning, there would, for example, be the possibility of retaining the atmosphere in the actual production area, i.e. of not flushing it on safety grounds, as is necessary in the prior art. In the case of inert-gas atmospheres in printing machines, for example, contamination in the product area can be avoided.

Notwithstanding this, however, advantages purely in terms of handling in the replacement of lamps or the prevention of contamination of the product area can be reasons for advantageously using the invention.

The invention also has advantageous possible applications outside the handling of actual products. For example, UV luminaires and in particular also VUV luminaires can be used in the sterilization of water. It is, of course, advantageous here if the separating pane can be directly adjacent to the water and replacement of a lamp possible without the separating pane being dismantled. Otherwise, for the purposes of replacing a lamp, a separating pane that is separate from the actual boundary of the water to be irradiated has namely to be provided, the addition of absorption losses being disadvantageous.

In other cases, the part remaining fixed in position with the separating pane should in any case be designed so as to be assembled at the place of use such that, with the separating pane, it forms, or forms part of, the base of the luminaire.

The housing part to be moved for opening may incidentally be the same for the plurality of lamps or else different for the different lamps, in particular be a different assigned housing part for each of the lamps respectively.

Furthermore, it is preferable for the opening to be effected through movement of the respective housing part under a constraining guide, i.e. for example through rotation about an axis of rotation predefined device-wise, i.e. by a rotary bearing, through displacement along a sliding guide, through a combination thereof or similar. The housing part should thus in particular not be completely freely moveable and also not detach completely from the remaining luminaire structure. The constraining guide preferably also provides a holder, when the lamp or another luminaire part, for example a reflector, is replaced. A particularly preferred mechanism is a lift-rotate mechanism, the lift movement being effected away from the separating pane and a rotate movement following on from the lift movement, when the housing is opened (and vice versa when it is closed). For illustration, the reader is referred to the exemplary embodiment.

The separating pane is preferably subdivided into a plurality of individual separating panes, in particular into one separating pane for each lamp respectively. This makes a thinner embodiment of the individual separating panes and thus lower absorption losses and a lower weight of the luminaire possible, because the pane has to bridge smaller distances. In addition, the pane can be individually replaced in a modular manner, as it were, for each lamp, as the need arises. In the case of VUV luminaires in particular, the materials used, including the separating panes, are affected by various degradation processes.

The modular structure already described with respect to the replacement of lamps, the protective atmosphere and the separating pane preferably also applies (even if not necessarily in combination with these features) to electronic ballasts for supplying the lamp and/or to respective lamp cooling devices with cooling-gas fans for cooling the lamps. These components are preferably also provided individually for each lamp respectively and can thus also be replaced individually. In addition to being easy to maintain and repair, a largely modular structure also has the advantage that UV luminaires of various sizes with different numbers of lamps can be designed and manufactured from combinations of different numbers of intrinsically largely identical basic modules. However, the UV luminaire within the meaning of this invention is a structurally uniform and coherent overall design, for example in the form of a frame holding the modules together, as the exemplary embodiment shows.

The invention is particularly appropriate for VUV discharge lamps, and especially tubular lamps, which are typically used in a plurality, arranged in parallel as a lamp array.

A further preferred aspect of the invention relates to the design of a UV reflector in the luminaire. This UV reflector has a cross-sectional profile of the reflecting surface transverse to the longitudinal direction of a tubular lamp, which profile is concave on the side facing away on the lamp side and is shaped in such a manner that light radiated by the lamp centrally on to the cross-section through the lamp transverse to the longitudinal direction is reflected past the lamp by the reflector.

The UV loading on the lamp itself is intended to be limited by this means. Just as the UV light produced for various applications has desired material-changing properties, lamp parts themselves can also be attacked. This applies particularly to VUV lamps and specifically to the transparent material of the lamp discharge vessel, for example to synthetic quartz glass. In principle, however, other lamp parts, for example luminescent material layers, may also be affected by such effects.

Irradiation through the walls of the discharge vessel by the UV light is initially unavoidable. However, in reflector luminaires, a considerable portion of the UV light generated is reflected by the reflector back through the lamp to the desired light exit side, the UV load increasing considerably as a result. This also applies in particular to lamps free of luminescent material, i.e. essentially clear lamps, in which no shading or absorption problems are to be expected.

The inventors have, however, established that the lifetime of VUV lamps in particular is limited by cracks and/or other symptoms of ageing, for example a reduced transmission of the discharge vessel walls, or at least that the output capacity of the lamp is disadvantageously restricted after a lengthy service life.

A reflector design is preferably provided in which reflected light that has been directed by conventional reflectors through the lamp is guided at least partially to the desired light exit side without passing through the lamp a second time. It is assumed here that the lamp is a tubular lamp, i.e. an elongated discharge vessel. The discharge vessel does not necessarily have either to be straightly elongated or have a circular cross-section. However, elongated cylindrical forms of the lamp are common and advantageous.

The UV reflector is accordingly also elongated, and is so along the length of the lamp.

Where reference is made here to a longitudinal direction, this of course relates in the case of the cylindrical geometry and other straightly elongated geometries to the direction of the longest extension of the lamp. In the case of curved geometries, then to a certain degree a local longitudinal extension and longitudinal direction is meant.

The UV reflector should be arranged at least on the side of the lamp opposite the desired light exit side, i.e. capture emitted light on this side, and be preferably closer to this side than to the side of the lamp oriented toward the light exit side.

The reflector is according to the invention concave and, at least in the area in which, in the case of straight reflector geometries perpendicular to the main light-emitting direction, a reflection into the lamp would occur, somewhat outwardly inclined, i.e. to a certain extent tilted compared with the prior art. The tilting relates in other words to a portion of the reflector surface located behind the lamp, viewed from the light exit side.

These statements apply (to a certain extent as a model and in the sense of a delimitation) to light emitted centrally by the lamp, i.e. light which, with respect to its direction of propagation, appears to come from a central longitudinal axis of the lamp, thus in the case of cylindrical lamps to radially emitted light.

This is not the only direction of propagation to occur, rather the UV lamps radiate diffusely. This applies both to lamps coated with a luminescent material, in which the discharge vessel wall radiates, and to lamps free of luminescent materials which to a certain extent radiate out of the volume in a great variety of directions. However, the central direction of propagation represents to a certain extent an average value for a considerable portion of the radiated light. If the reflector geometry guides this portion past the lamp itself, then this applies all the more to a considerable further portion of the light, namely the portion with the greater "outward tendency" so to speak. Another portion, with a greater "inward tendency" so to speak, may well, at least partially, be reflected into the lamp again. Overall, however, the proportion of the UV light which is reflected into the lamp again is reduced quite significantly.

Incidentally, the statement that central rays are no longer reflected into the lamp but are reflected past the lamp preferably also applies to the entire reflector surface and not only to the area "behind" the lamp.

The problems of lamp damage caused by the lamp's own UV light are especially relevant in the case of very short-wave UV light, i.e. in particular in the case of VUV lamps. By the same token, the invention preferably relates to excimer discharge lamps.

A preferred geometry of the reflector is a cylinder lateral surface. This relates initially only to the reflector surface. In many cases, however, the supporting wall of the reflector will likewise have a geometry corresponding to the reflecting surface. The cylinder axis does not of course lie on the central axis of the lamp, but further outward to the respective side; the cylinder lateral surface part is thus tilted outwardly, as an exemplary embodiment illustrates.

Polygonal reflectors with concave corners are a further preferred geometry. The term "concave" thus refers not only to rounded surfaces. Polygonal reflectors may in this case be of one piece or of several pieces.

Also of interest is efficient lamp cooling. This applies particularly in interaction with the invention. The lower UV loading of the lamp vessel makes it namely possible for the lamp outputs to be increased further, so the cooling problems are exacerbated. In this connection, continuous through-openings in the reflector in the longitudinal direction previously mentioned are preferred, i.e. on the side of the lamp opposite the main light exit side. Cooling gas which is moved by a fan can flow through these through-openings. The cooling gas may in a further preferred embodiment be cooled by a heat exchanger which is in turn liquid-cooled, in particular water-cooled. A cooling-gas recirculation is preferred in this case. This relates in particular to a cooling-gas recirculation in a closed luminaire housing which is filled with a protective gas which serves as a cooling gas. The protective gas is oxygen-free and protects the interior of the luminaire from excessive ozone concentrations arising through the interaction of VUV radiation with atmospheric oxygen.

A correspondingly equipped luminaire can, as stated, be used in particular in industrial production processes, for example for cleaning substrates, for instance in the manufacture of displays.

BRIEF DESCRIPTION OF THE DRAWINGS

The invention will be described in more detail below with reference to the figures and the exemplary embodiment represented therein. Individual features may also be essential to the invention in other combinations and, as previously established, be of significance for all the categories of claims:

DETAILED DESCRIPTION

The following detailed description refers to the accompanying drawings that show, by way of illustration, specific details and embodiments in which the invention may be practiced.

Figure 1:
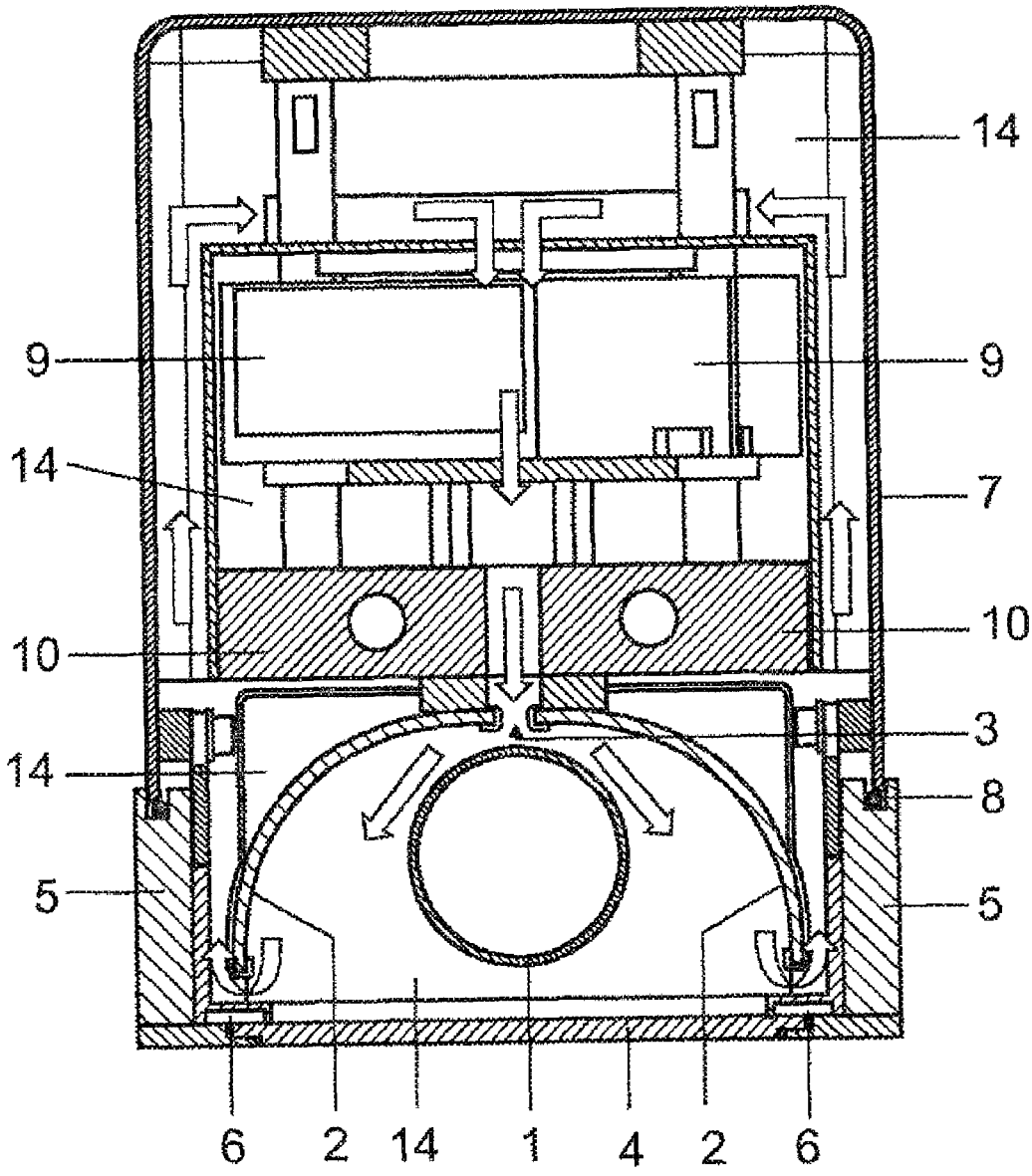
FIG. 1 shows a section, transverse to the longitudinal direction, through a part of a UV luminaire according to the invention.

FIG. 1 shows a part of a UV luminaire according to the invention in cross-section. In the lower area, a circular section through a cylindrical Xeradex-type VUV lamp which is elongated perpendicularly relative to the plane of the drawing is labeled 1, said lamp generating VUV light with a wavelength of 172 nm by means of an inert-gas excimer discharge. Details of this lamp 1 will not be closely examined because it is known per se.

The cylindrical discharge vessel wall of synthetic quartz glass which can be seen in the Figure allows VUV radiation generated in the interior of the lamp 1 to pass through to the outside, the radiation being generated in principle in the entire volume of the lamp 1. The quartz glass walls react to very large VUV doses by cracking or exhibiting deteriorated transmission behavior. On the other hand, efforts have been made to maximize the output of the lamp 1 as far as possible. In particular, this makes it possible for the necessary residence times of irradiated surfaces to be reduced, for instance for the cleaning of substrates for the manufacture of TFT displays. Short residence times reduce the throughput times and the production costs.

In FIG. 1, a two-part reflector 2 composed of two cylinder-lateral-surface-shaped glass panes is provided which, in the transverse section shown, each make up somewhat more than a quarter circular ring. The glass panes of the reflectors 2 are metal-coated on the concave inner side and thus also exhibit good reflectivity at the wavelength of 172 nm.

Between the upper ends of each of the reflector parts 2 a narrow gap, here labeled 3, has been left as a through-opening for cooling gas. From there, the reflector parts 2 each extend downward around the lamp 1, the distance from the lamp 1 steadily increasing and the lower ends of each of the reflector parts 2 lying on approximately the same level as the bottom edge of the lamp 1. Thereunder, a quartz glass pane labeled 4 is connected which separates the interior of the luminaire from a production line lying in turn thereunder. In the production line, ozone is generated in a relatively high concentration by the VUV irradiation, while the interior of the luminaire housing in contrast contains in a sealed-off manner a protective-gas atmosphere, namely pure nitrogen. This prevents corrosive attacks by ozone on inner luminaire components and reduces the absorption of VUV radiation between the lamp 1 and the quartz-glass pane 4. The nitrogen atmosphere serves additionally as a cooling gas.

The luminaire housing consists substantially of a lower frame 5 on which a lower flange supports the quartz-glass pane 4, the junction between the flange and the quartz-glass pane 4 being sealed inwardly by means of a seal, and furthermore of an upper cover 7 which is likewise connected in a sealed manner to the frame 5 via a seal 8.

The luminaire housing shown in FIGS. 1 to 5 thus encloses a chamber 14, the reference character 14 in FIG. 1 being plotted at various points in order to show that the chamber defines the inner gas volume of the luminaire housing. This chamber 14 is, as will be evident further below from FIGS. 6 and 7, only a modular chamber of the overall luminaire which consists of multiple, here a total of four, such chambers 14.

A fan 9 is mounted in the luminaire housing, which fan sucks gas from above and blows it through a heat exchanger labeled 10 to the previously mentioned through-opening 3 and through this onto the lamp 1. The heat exchanger 10 thus forms centrally a vertical shaft for cooling the nitrogen cooling gas. The air movement is marked by arrows and passes through below the lower edges of the reflector parts 2 and upward past the outside of the frame 5 and the cover 7.

This cooling according to the invention combines on the one hand the effectiveness of liquid cooling with on the other hand the advantages of having no contact cooling of the lamp itself (through contact with a cooling block). This provides space behind the lamp for the arrangement of reflectors according to the invention. Effective cooling is essential to the efficiency of VUV generation. Apart from that, cooling-gas cooled lamps are easier to replace than liquid-cooled lamps. There is also a greater tolerance with regard to geometric variances of the lamps which in individual cases have considerable lengths (for example up to 2 m).

Figure 2:
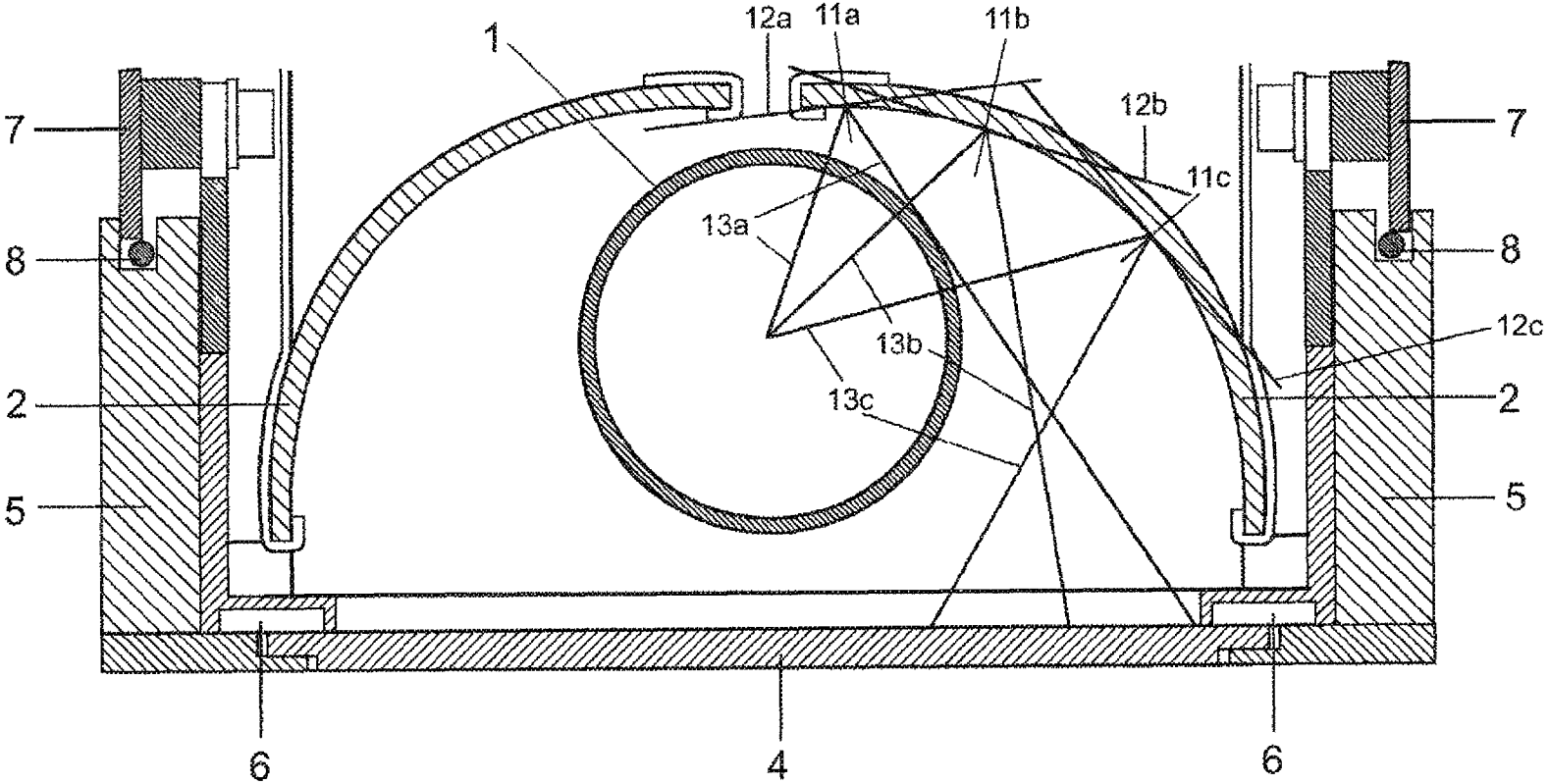
FIG. 2 shows for illustrative purposes a section from FIG. 1 with typical ray paths.

FIG. 2 shows an enlarged view of the lower third of the cross-section from FIG. 1 and with ray paths for reasons of clarity. Radial portions of the cylindrical reflector part 2 are labeled 11*a, b, c* respectively, tangent portions 12*a, b, c* respectively and ray paths emitted radially from the lamp 1 (i.e. seeming to originate from the cylinder axis of the lamp 1) 13*a, b, c* respectively.

The radial portions 11*a-c* show that the cylinder axis of the reflector part 2 lies approximately in the lower right-hand edge region of the lamp 1. The same applies mirror-symmetrically to the left-hand reflector part 2 (not furnished with ray paths), the cylinder axis of which lies in the lower left-hand edge region of the lamp 1. The top ends are accordingly tilted outwardly somewhat in the region surrounding the through-opening 3 and the region adjacent thereto. The ray 13*a*, which strikes the leftmost reflecting part (directly adjacent to the fastening clip not labeled in greater detail) of the right-hand reflector part 2 is thus reflected so far to the right that it runs past the lamp 1. The same applies to the rays 11*b* and 11*c* striking further to the right and would also apply to rays in the part of the reflector surface running still further to the right and down.

Thus a considerable portion even of the light emitted backward by the lamp 1 is reflected forward past the lamp 1 itself and rendered usable without increasing the VUV dose of the discharge vessel of the lamp 1.

It can, however, also be seen that this is not necessarily true of all rays from the lamp 1. If the ray 13*a* is imagined extended through the entire lamp 1, then it becomes clear that all rays originating from the half of the cross-section through the lamp 1 lying to the left thereof will also be reflected past the lamp 1, even if they strike the right-hand reflector part 2 on the far left. This is not true, however, of all rays generated in the right-hand half. If these strike the right-hand reflector part 2 on the far left or relatively far to the left, reflections into the lamp 1 may also occur. Overall, however, this proportion of the light reflected back into the lamp 1 is significantly reduced compared with reflectors not fashioned according to the invention.

Figure 3:
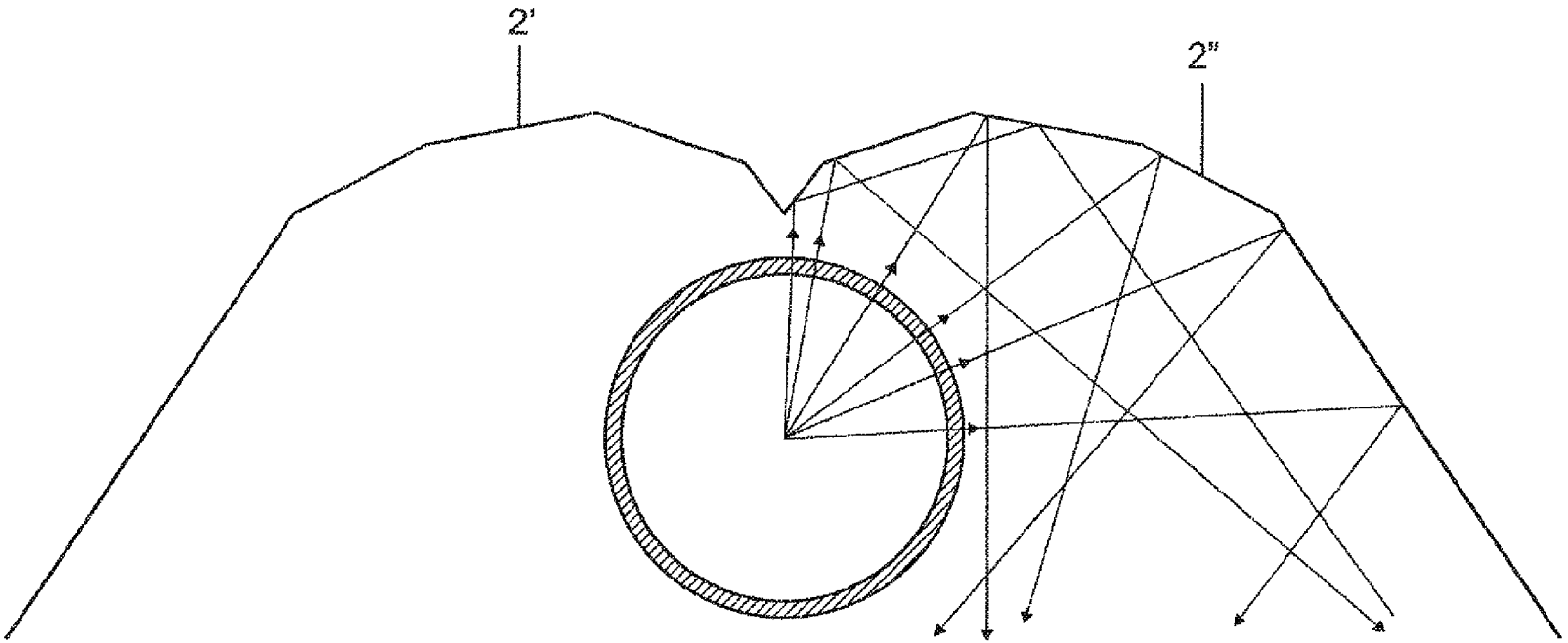
FIG. 3 shows a variant of the exemplary embodiment from FIGS. 1 and 2 with ray paths for comparison with FIG. 2.

FIG. 3 shows a variant. The lamp and the ray paths are no longer numbered, but the reflector parts, fashioned here in a polygonal manner, are numbered 2' and 2". The reflector parts 2' and 2" are thus polyhedrons which in cross section constitute polygonal chains. The left-hand reflector part 2' consists of four planar facets, the right-hand reflector part 2" of five facets. The ray paths inscribed on the right illustrate the same basic principle as in FIG. 2, which also applies to the left-hand reflector part 2". Incidentally, no through-opening for cooling gas is provided here, but one could easily be inserted by omitting or centrally shortening each of the innermost facets.

Of course, more complicated reflector surfaces than cylindrical curved reflector surfaces are also conceivable, in particular also so-called involute reflectors. The latter are known from lighting technology, but serve the purpose there of achieving as even as possible a distribution of luminance in conventional fluorescent lamps. In this context, homogeneity is not essentially the issue. The cylinder lateral surfaces are therefore preferable because they are easier to manufacture.

Figure 4:
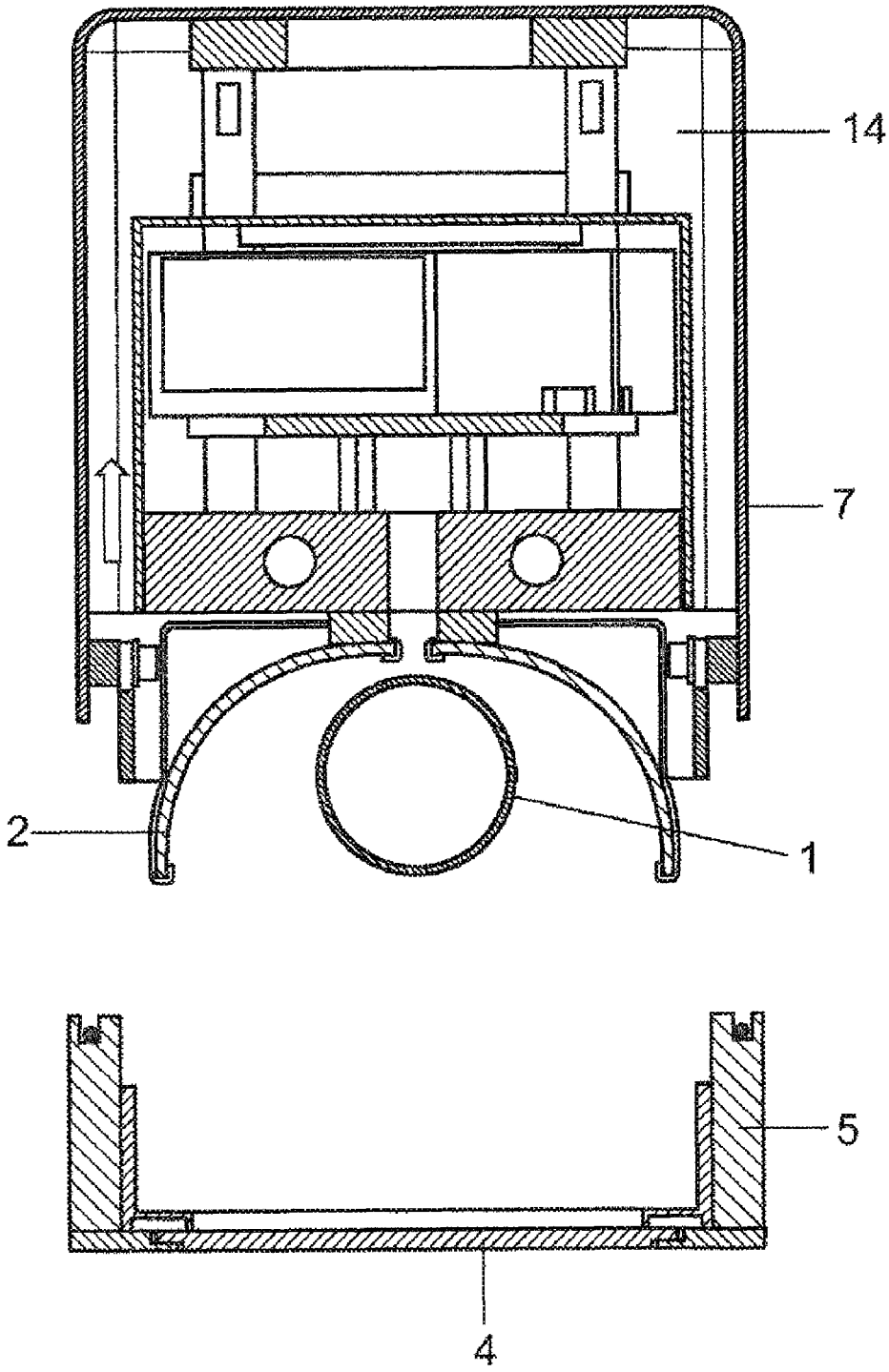
FIG. 4 shows a section, corresponding to FIG. 1, with the housing open.

In FIG. 4, for the sake of simplicity, not only all the individual parts are labeled as in FIG. 1. The difference between the two figures is that in FIG. 4, the top cover 7 is run as a movable housing part upward along a sliding guide shown in FIGS. 6 and 7 and explained later. The seal 8 has remained on the frame 5, which in turn has remained stationary as a fixed housing remnant with the quartz-glass pane 4 and the seal 6 and the other associated parts. With the cover 7, the parts mounted therein, in particular the lamp 1 and the reflector 2, are displaced upward.

The chamber 14, the luminaire housing interior of the module shown, is thus open.

Figure 5:
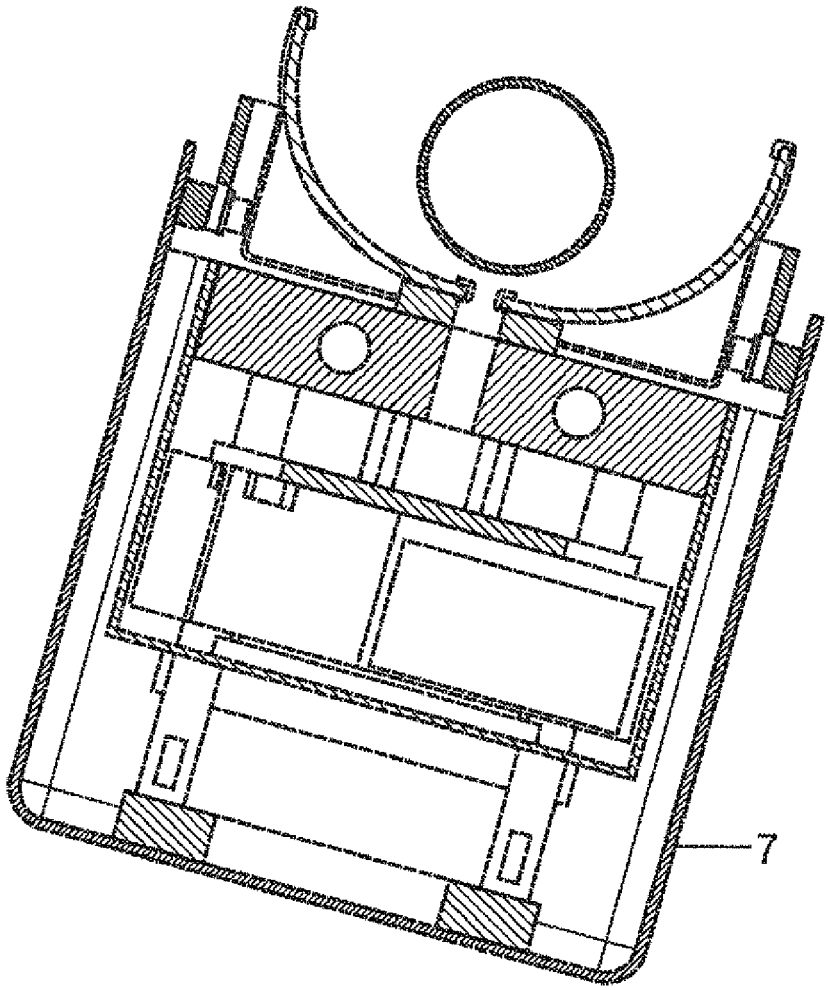
FIG. 5 shows a representation, corresponding to FIG. 4, but with the housing cover rotated.
Figure 5:
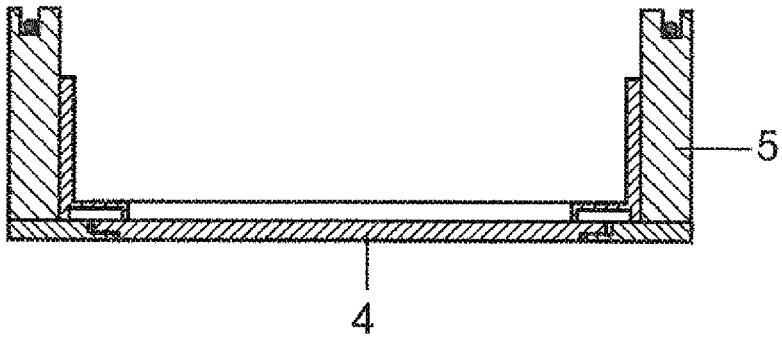

In FIG. 5, this upwardly displaced luminaire part is rotated about an axis of rotation which stands perpendicular to the drawing plane, the reflector 2 and the luminaire 1 being essentially upwardly exposed and thus easily accessible for replacement. A converse sequence of movements, i.e. a reverse rotation back to the position shown in FIG. 4 and then a downward movement of the upper luminaire part to the position shown in FIG. 1 is carried out after maintenance or parts replacement.

Figure 6:
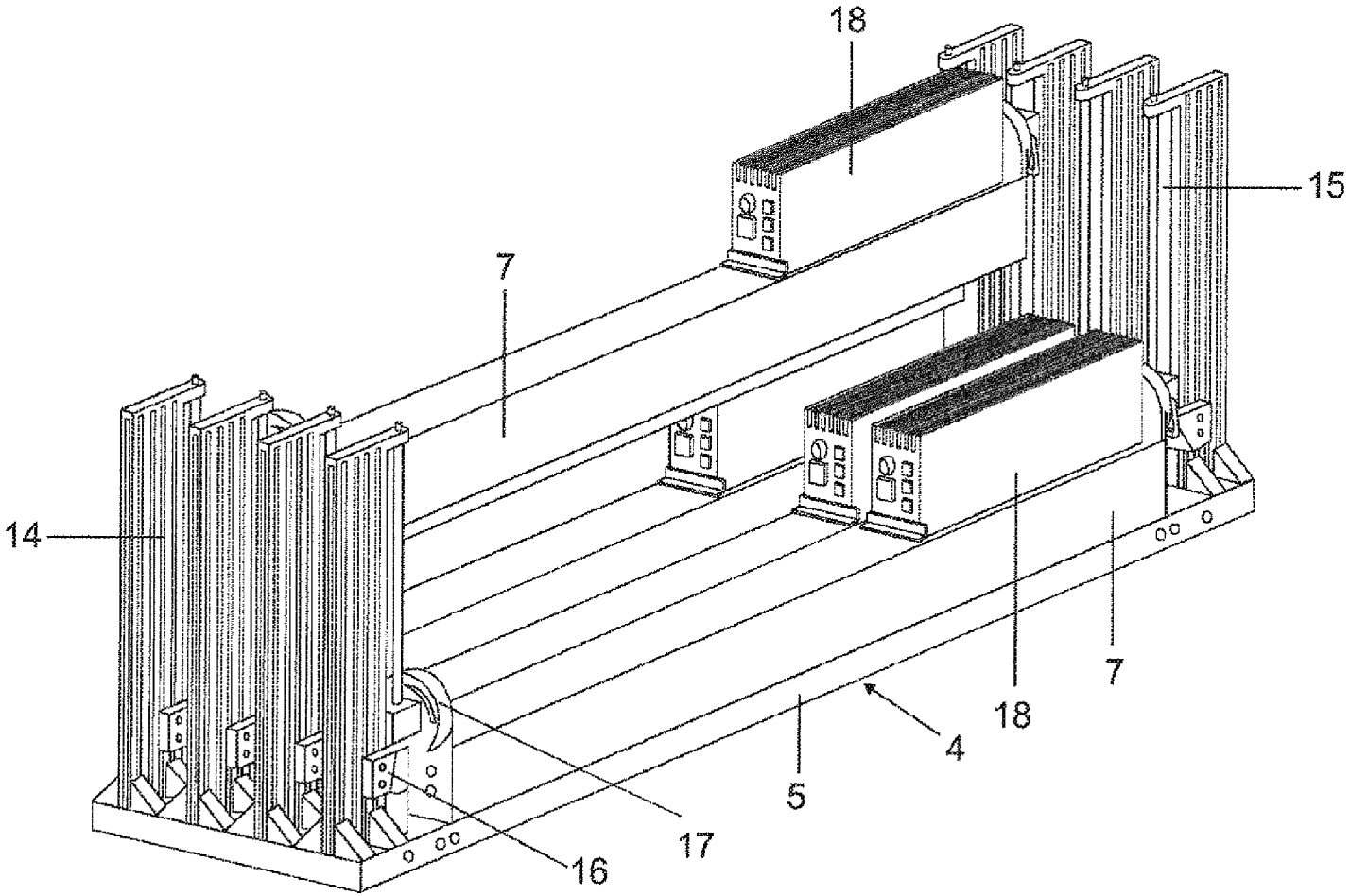
FIG. 6 shows a perspective overall representation of a luminaire according to the invention including multiple units in accordance with FIGS. 1-5, the housing of one of said units being open in accordance with FIG. 4.
Figure 7:
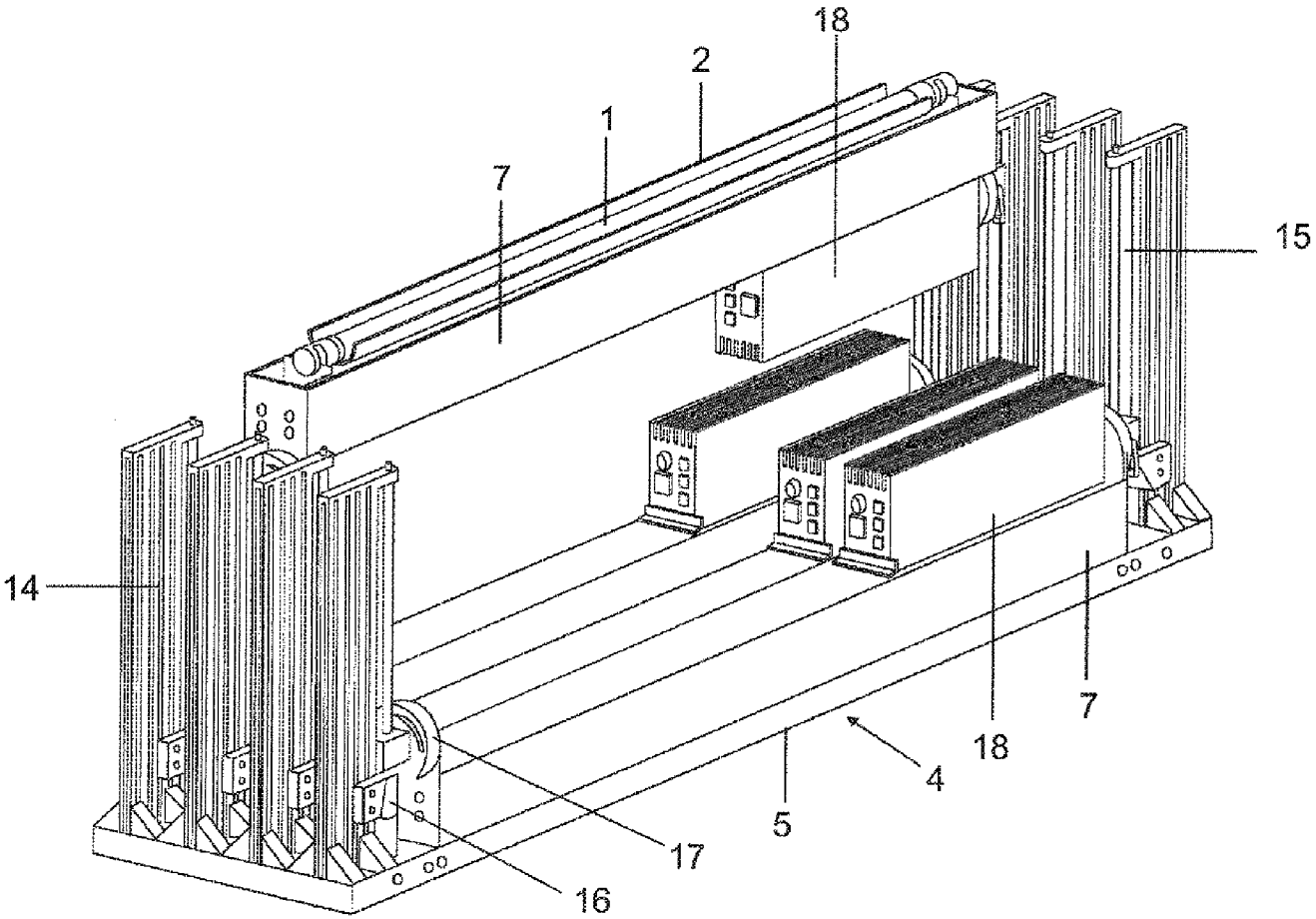
FIG. 7 shows a representation corresponding to FIG. 6, but with an opening state analogous to FIG. 5.

FIGS. 6 and 7 illustrate this sequence with the aid of perspective representations of the entire luminaire. This luminaire consists of a frame 5 in accordance with FIGS. 1 to 5 which is provided jointly for the respective quartz-glass panes 4 of the four respective lamps 1 arranged parallel adjacent to one another. In FIG. 7, one of the lamps 1 can be seen inside the raised and rotated cover 7 (cf. FIG. 5). The other lamps 1 are arranged inside the three further covers 7. There are thus three closed chambers and one open chamber 14 here.

Supports 14 standing vertically upward are arranged on the frame 5, four at front left and four at back right. Guide rods 15 which are encompassed by guide collars 16 are held on each of the supports 14. These collars 16 are each fastened via a rotary joint 17 over the upper horizontal wall of the cover 7 and on their faces. Via these rotary joints 17, the covers 7 can be rotated when they have been raised by displacing the collars 16 along the guide rods 15, as shown in FIGS. 6 and 7.

From the combination of figures, it is evident that in a modular design each lamp 1 has been provided with its own inert-gas chamber 14 (general protective-gas chamber), its own quartz-glass pane 4, its own reflector 2 and its own cooling device 9, 10. In addition, FIGS. 6 and 7 show that each of these modules has its own electronic ballast 18. This is mounted outside the cover 7 and easily accessible on the top thereof.

Overall, the structure of the whole luminaire is recognizably largely modular in design and is held together by the shared frame structure 5. By means of this frame 5, the VUV luminaire is fitted to an ozone cleaning device for processing TFT displays and thus lies above a production line (not shown) for the displays. In this cleaning section of the production line, a nitrogen atmosphere prevails, a considerable portion of which is converted by VUV radiation into ozone, as is known per se.

As a consequence of the modular design, when one of the lamps 1 has to be replaced, only the chamber 14 directly affected thereby has to be opened and the nitrogen atmosphere contained therein disturbed. The remaining modules are not affected thereby. Depending on whether, even without the lamp that has just been raised, the necessary lamp output can be achieved—possibly by prolonging the residence time—or else by appropriately redundant output design, cleaning operations may even continue to run. Even when they are interrupted, this is only for the period necessary for the actual maintenance works and the flushing steps which are required for restoring the required nitrogen purity in the chamber 14. These times are significantly shorter than when restoring a protective-gas atmosphere in a larger cohesive luminaire housing, particularly if this housing is correspondingly more complex in structure.

In particular, the panes 4 with the frame 5 remain rigidly connected to the cleaning device, so the oxygen or ozone atmosphere is not touched while one or several of the modules are replaced. According to the prior art, considerable time losses before and after maintenance work are sometimes necessary for venting and flushing processes because the ozone concentration inside the production line is very dangerous or, even where an inert-gas atmosphere is used inside the production line, for example in printing machines, this atmosphere has to be restored to the necessary purity.

While the invention has been particularly shown and described with reference to specific embodiments, it should be understood by those skilled in the art that various changes in foiui and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A UV luminaire, comprising:

a housing which is configured to accommodate a plurality of UV lamps and a protective atmosphere, wherein the housing is subdivided into chambers respectively containing some of the UV lamps and can be opened in such a manner that each of the UV lamps can be replaced with detriment to the protective atmosphere only of the respective chamber.

2. The UV luminaire as claimed in claim 1, wherein each chamber contains precisely one UV lamp.

3. The UV luminaire as claimed in claim 1, wherein the housing has at least one UV-transparent separating pane for demarcating between the housing exterior and the housing interior and can be opened in such a manner that each of the UV lamps can be replaced after moving a part of the housing, wherein the separating pane remains unmoved relative to the remainder of the luminaire.

4. The UV luminaire as claimed in claim 1, wherein a plurality of housing parts are provided which, to open the housing and replace a respective lamp, can respectively be detached by being moved under a constraining guide.

5. The UV luminaire as claimed in claim 4, wherein the constraining guide is implemented in a lift-and-rotate mechanism, by means of which the respective housing part can be displaced in a direction away from the separating pane and, in the displaced state, can be rotated for improved accessibility of the UV lamp.

6. The UV luminaire as claimed in claim 1 wherein the separating pane comprises a plurality of separating panes.

7. The UV luminaire as claimed in claim 6, wherein one separating pane is provided for each UV lamp.

8. The UV luminaire as claimed in claim 1 further comprising:

a plurality of electronic ballasts.

9. The UV luminaire as claimed in claim 8, wherein one electronic ballast is provided for supplying each UV lamp.

10. The UV luminaire as claimed in claim 1, further comprising:

a plurality of lamp-cooling devices.

11. The UV luminaire as claimed in claim 10, wherein one lamp-cooling device with a cooling-gas fan is provided for cooling each UV lamp.

12. The UV luminaire as claimed in claim 1, which is fashioned as a VUV luminaire having a wavelength of below 200 nm.

13. The UV luminaire as claimed in claim 1, which is designed for tubular UV lamps.

14. The UV luminaire as claimed in claim 13, further comprising:

a UV reflector along a longitudinal direction of the lamp on a side of the lamp facing away from a main light exit side, which has a cross-sectional profile of the reflecting surface transverse to the longitudinal direction which, on the side facing way, is concave on the lamp side and is partially somewhat outwardly inclined in such a manner that light emitted from the lamp centrally on to the cross-section through the lamp transverse to the longitudinal direction is reflected by this inclined part of the reflector past the lamp.

15. The UV luminaire as claimed in claim 14, whereinin which the reflector has a through-opening, which is elongated in the longitudinal direction, for cooling gas.

16. A device for implementing a technical process with products using UV light, the device comprising:

a UV luminaire, comprising:

a housing which is designed for accommodating a plurality of UV lamps and a protective atmosphere., wherein the housing is subdivided in such a manner into chambers respectively containing some of the UV lamps and can be opened in such a manner that each of the UV lamps can be replaced with detriment to the protective atmosphere only of the respective chamber, and a product-holding device for the products to be treated by means of the process.

17. The device as claimed in claim 16, further comprising:

a gas container containing the product-holding device, which is designed not to open the gaseous atmosphere in the gas container when the housing part is opened and the UV lamps replaced.

18. Use of a UV luminaire, the UV luminaire comprising:

a housing which is designed for accommodating a plurality of UV lamps and a protective atmosphere, wherein the housing is subdivided in such a manner into chambers respectively containing some of the UV lamps and can be opened in such a manner that each of the UV lamps can be replaced with detriment to the protective atmosphere only of the respective chamber, for a device, the device comprising:

the UV luminaire, and a product-holding device for the products to be treated by means of the process.

* * * * *